US009185962B2

(12) United States Patent
Holloway

(10) Patent No.: US 9,185,962 B2
(45) Date of Patent: Nov. 17, 2015

(54) ELEVATOR CUP AND DISPENSING DEVICE INCORPORATING THE SAME

(71) Applicant: HCP Packaging USA, Inc., Shelton, CT (US)

(72) Inventor: Thomas F. Holloway, Essex, MD (US)

(73) Assignee: HCP Packaging USA, Inc., Shelton, CT (US)

( * ) Notice: Subject to any disclaimer, the term of this patent is extended or adjusted under 35 U.S.C. 154(b) by 0 days.

(21) Appl. No.: 14/214,454

(22) Filed: Mar. 14, 2014

(65) Prior Publication Data

US 2014/0270889 A1 Sep. 18, 2014

Related U.S. Application Data

(60) Provisional application No. 61/793,460, filed on Mar. 15, 2013.

(51) Int. Cl.

| | |
|---|---|
| ***A45D 40/02*** | (2006.01) |
| ***A45D 40/12*** | (2006.01) |
| ***A45D 40/00*** | (2006.01) |

(52) U.S. Cl.

CPC ..... *A45D 40/00* (2013.01); *A45D 40/02* (2013.01); *A45D 40/12* (2013.01); *A45D 2040/0062* (2013.01)

(58) Field of Classification Search

CPC ..... A45D 2040/0062
USPC ..... 401/78, 86, 87, 88
See application file for complete search history.

(56) References Cited

U.S. PATENT DOCUMENTS

| | | | | |
|---|---|---|---|---|
| 2,318,152 | A | 8/1941 | Gelardin | |
| 2,351,395 | A | 6/1944 | Broder | |
| 2,704,598 | A | 3/1955 | Casey | |
| 2,815,123 | A | 12/1957 | Safianoff | |
| 3,298,509 | A | 1/1967 | Hultgren | |
| 4,820,070 | A | 4/1989 | Spatz | |
| 5,324,125 | A | 6/1994 | Ackermann | |
| 5,560,727 | A * | 10/1996 | Vaupel | 401/78 |
| 5,609,430 | A | 3/1997 | Mazzola et al. | |
| 5,842,805 | A | 12/1998 | Pierpont | |
| 5,888,004 | A | 3/1999 | Bouix | |
| 6,116,801 | A * | 9/2000 | Patel et al. | 401/78 |
| 6,126,351 | A | 10/2000 | Gueret | |
| 6,244,770 | B1 * | 6/2001 | Holloway | 401/78 |
| 6,293,721 | B1 | 9/2001 | Bow et al. | |
| 6,843,611 | B2 | 1/2005 | Blondeel et al. | |
| 7,357,588 | B2 | 4/2008 | Liard | |
| 7,883,286 | B2 | 2/2011 | Thiebaut | |
| 2006/0291948 | A1 | 12/2006 | Holloway | |
| 2007/0217857 | A1 | 9/2007 | Ho | |

(Continued)

*Primary Examiner* — David Walczak
*Assistant Examiner* — Joshua Wiljanen
(74) *Attorney, Agent, or Firm* — Thomas P. O'Connell; O'Connell Law Firm

(57) ABSTRACT

An elevator cup for retaining a cosmetic pomade in relation to a cosmetic dispenser. An annular peripheral wall defines an inner volume for longitudinally receiving and retaining the cosmetic pomade, and a plurality of fins that project radially inward from the peripheral wall. The fins can be disposed in clusters comprising at least two fins angularly spaced by approximately forty degrees or less to establish a dovetail configuration. Clusters can have three fins, potentially with a center fin of a reduced radial dimension compared to outer fins. The clusters can be evenly spaced around the annular peripheral wall.

16 Claims, 6 Drawing Sheets

(56) References Cited * cited by examiner

U.S. PATENT DOCUMENTS

| | | | |
|---|---|---|---|
| 2008/0163881 | A1 | 7/2008 | Saunders et al. |
| 2010/0284724 | A1 | 11/2010 | Cardia |

ELEVATOR CUP AND DISPENSING DEVICE INCORPORATING THE SAME

RELATED APPLICATION

This application claims priority to U.S. Provisional Patent Application No. 61/793,460, filed Mar. 15, 2013, which is incorporated herein by reference.

FIELD OF THE INVENTION

The present invention relates generally to dispensers for products dispensed in stick or pomade form, such as stick-type cosmetic products and personal care and hygiene products. More particularly, disclosed and protected herein is an elevator cup and a dispensing device employing such an elevator cup for retaining and dispensing a solid or semi-solid product, such as a cosmetic product, wherein the elevator cup has a peripheral wall with a plurality of inwardly extending fins configured to provide stable axial and orbital support and retention to the product without fracturing or compromising the structural integrity of the product during insertion or use.

BACKGROUND OF THE INVENTION

Solid and semi-solid cosmetic products, such as lipsticks and lip balms, are typically retained in stick or pomade form by an elevator cup that is extended and retracted along a track within a cylindrical sleeve of a dispenser body. The pomade can be loaded into the elevator cup either automatically or manually. With manual filling, stick-shaped pomades are typically pre-formed in a mold, chilled, and pressed into the elevator cup of the dispenser by hand. Automatic filling commonly involves molding and chilling the pomade and then ejecting it of the mold and into the elevator cup.

Historically, frictional forces between the pomade and the inside wall of the elevator cup were exploited to retain the pomade relative to the elevator cup and the dispenser in general. However, it is known that modern wear-resistant, silicone-based lipsticks commonly have reduced diameters as compared to conventional lipsticks. It has further been found that such cosmetic pomades tend to be slippery and to shrink over time. These factors have posed challenges to the secure axial and orbital retention of the pomade, particularly over time. Manufacturers commonly must conduct drop tests and other examination and testing seeking to ensure that retained pomades will avoid orbital and axial movement relative to the elevator cup during use.

Attempts have been made to improve the retention of such stick-like products in relation to elevator cups of retractable dispensers. For example, U.S. Patent Application Publication No. 2007/0217857 of Ho, U.S. Pat. No. 4,983,059 to Holloway, and U.S. Pat. No. 7,357,588 to Liard each disclose dispensers with a plurality of longitudinal ribs or fins that project inwardly from a peripheral wall of an elevator cup. In each instance, the ribs are designed to slice or project into the pomade once the pomade is disposed in the elevator cup thereby to assist in gripping it and preventing the pomade from shifting or becoming dislodged in relation to the elevator cup during use. With U.S. Pat. No. 5,609,430, Mazzola et al. sought to further combat the issues presented by slippery, shrinking cosmetic pomades by employing plural inwardly extending ribs that have a radial curvature for preventing axial and orbital displacement of the pomade. Even further, Spatz in U.S. Pat. No. 4,820,070 suggests employing ribs with dove-tail cross-sections.

Such rib configurations have represented useful contributions to the art and have assisted in better retaining cosmetic pomades during installation, transport, and use. However, even the combined prior art has left a plurality of deficiencies and issues with respect to the competing goals of seeking stable retention of a cosmetic pomade against axial and orbital movement while avoiding deleterious harm to the structural integrity of the retained cosmetic pomade. For instance, prior art structures with relatively abbreviated ribs or fins advantageously avoid excessive damage to the pomade structure, but they are limited in their resistance to orbital and axial displacement of the cosmetic. Conversely, prior art dispensers as taught, for instance, by Spatz and Mazzola et al. with irregularly shaped ribs might well achieve greater mechanical and frictional engagement between the ribs and the pomade, but the piercing the body of the pomade with irregularly shaped ribs produces the necessary result of localized, and at times generalized, deformation and damage to the pomade body. With that, the structural integrity of the pomade tends to be compromised thereby producing an elevated risk of structural failure during use or as a result of impacts on the pomade and the cosmetic dispenser in general.

It will thus be recognized that there remains a need for an improved elevator cup for stick-shaped products that provides stable support and retention of the pomade against orbital and axial displacement while avoiding excessive damage to the pomade and structural vulnerabilities deriving therefrom.

SUMMARY OF THE INVENTION

With a knowledge of foregoing, the present invention is founded on the basic object of providing an elevator cup for retaining a stick-shaped product and a dispensing device incorporating the same that provides stable support and retention to the product.

A more particular object of embodiments of the invention is to provide an elevator cup for retaining stick-shaped products and a dispensing device incorporating the same that resists orbital and axial displacement of the product while avoiding excessive damage to the product and the structural vulnerabilities deriving therefrom.

These and in all likelihood further objects and advantages of the present invention will become obvious not only to one who reviews the present specification and drawings but also to those who have an opportunity to make use of an embodiment of a dispensing device incorporating the elevator cup disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, one potential embodiment of the elevator cup for retaining a cosmetic pomade in relation to a cosmetic dispenser is founded on an annular peripheral wall that defines an inner volume for longitudinally receiving and retaining the cosmetic pomade. A plurality of fins project radially inward from the peripheral wall. The fins are longitudinally disposed within the inner volume defined by the annular peripheral wall. At least some of the fins can be disposed in a cluster comprising at least two fins with the fins of the cluster being spaced over an angular span.

While the angular span of the cluster can vary, the fins of the cluster can be angularly spaced over an angular span of approximately forty degrees or less whereby a dovetail configuration is established between the fins of the cluster. Moreover, there can be plural clusters, each cluster comprising at least two fins, with the clusters being separated by angular spans. The angular spans separating the clusters can be greater than the angular spans of the clusters whereby dovetailed portions are defined within the clusters and angular spaces are disposed between clusters. By way of example, the fins of the cluster can be spaced over an angular span of forty degrees or less or, even more particularly, by approximately twenty degrees or less. With this, a dovetail configuration is established between the fins so that a dovetail retention effect is achieved, including in the event of a shrinking of the cosmetic pomade.

It is possible for clusters to have as few as two fins, or clusters can have three fins. Indeed, clusters could have eight fins or more. Where there are at least three fins in the cluster, the cluster will have at least one central fin and first and second outer fins. In such a construction, the central fin projects radially inward from the peripheral wall by a distance less than a distance that the first and second outer fins project radially inward from the peripheral wall. In certain manifestations of the invention, the first and second outer fins of the cluster can be spaced over an angular span of forty degrees or less.

While just one cluster may be practicable, the elevator cup could have at least two clusters. Where there are plural clusters, the clusters can be spaced substantially evenly around the annular peripheral wall.

In an alternative embodiment of the invention, an elevator cup for retaining a cosmetic pomade in relation to a cosmetic dispenser can again be founded on an annular peripheral wall that defines an inner volume for longitudinally receiving and retaining the cosmetic pomade. A plurality of fins can again project radially inward from the peripheral wall and be longitudinally disposed within the inner volume defined by the annular peripheral wall. At least some of the fins can be angularly spaced by approximately forty degrees or less. With that, a dovetail configuration will be established between the fins spaced by approximately forty degrees or less to create the dovetail retention effect contemplated herein.

In certain embodiments, for example, at least nine fins can be spaced substantially evenly around the annular peripheral wall. In other embodiments, at least twelve fins can be spaced substantially evenly around the annular peripheral wall.

While they need not necessarily be, at least some of the fins can be disposed in a cluster comprising at least two fins spaced over an angular span. The fins of the cluster could, for example, be angularly spaced over an angular span of approximately forty degrees or less whereby a dovetail configuration is established between the fins of the cluster.

There can be plural clusters, each cluster comprising at least two fins, separated by angular spans. The angular spans separating the clusters can in particular constructions be greater than the angular spans of the clusters. The fins of the cluster can, by way of example, be spaced over an angular span of forty degrees or less.

Where the fins are disposed in clusters, there could be at least three fins in each cluster so that the cluster has at least one central fin and first and second outer fins. In such constructions, the fins could be of similar radial depth. Alternatively, the center fin can project radially inward by a distance less than a distance that the first and second outer fins project radially inward. Moreover, the first and second outer fins of the cluster can be spaced by forty degrees or less or even twenty degrees or less. While such need not necessarily be the case, the clusters can be spaced substantially evenly around the annular peripheral wall.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

Figure 1:
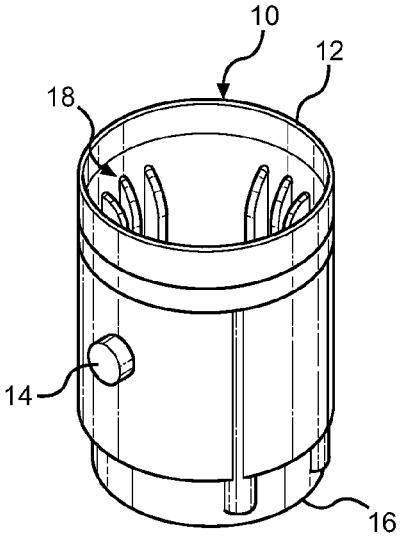
FIG. 1 is a perspective view of an elevator cup as disclosed herein.
Figure 2:
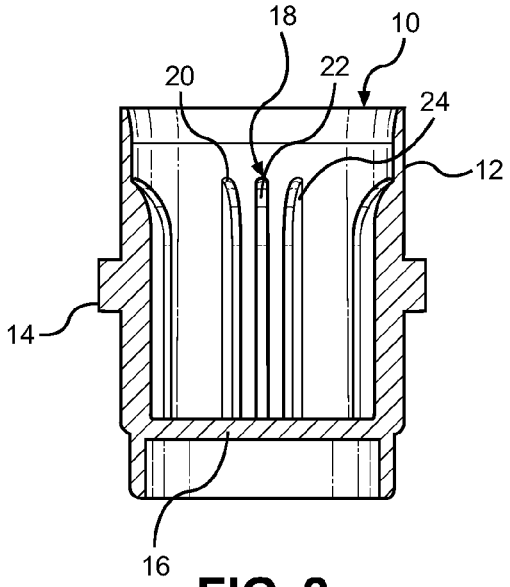
FIG. 2 is a cross-sectional view of the elevator cup of FIG. 1.
Figure 3:
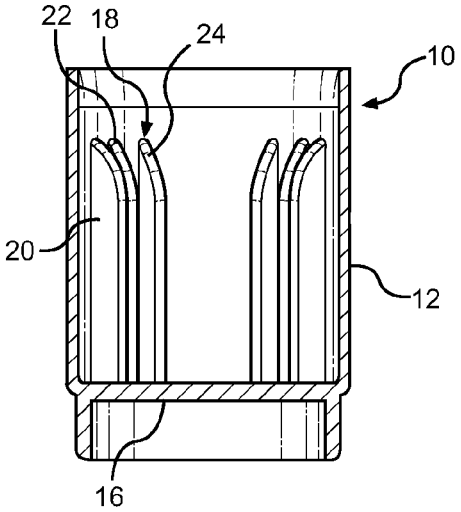
FIG. 3 is an alternative cross-sectional view of the elevator cup of FIG. 1.

The elevator cup disclosed herein and dispensing devices incorporating the same are subject to varied embodiments. To ensure that one skilled in the art will be able to understand and, in appropriate cases, practice the present invention, certain preferred embodiments of the broader invention revealed herein are described below and shown in the accompanying drawing figures. Before any particular embodiment or aspect thereof is explained in detail, it must be made clear that the following details of construction and illustrations of inventive concepts are mere examples of the many possible manifestations of the invention. It will be further appreciated that, while the present discussion relates to dispensing devices for enabling the retention and application of cosmetic pomades, the invention disclosed herein is not so limited and may be readily applied to other industries beyond the field of cosmetics except as it might be expressly limited.

In carrying forth the objects of the invention, an elevator cup pursuant to the present invention for retaining a cosmetic pomade is indicated generally at 10 in FIGS. 1 through 5. There, the elevator cup 10 has a peripheral wall 12 that is substantially cylindrical. A bottom wall 16, which is substantially flat, forms a bottom of the elevator cup 10, and a cosmetic pomade (not shown) can be disposed with an end thereof retained within the open inner volume defined by the peripheral and bottom walls 12 and 16. The cosmetic pomade will typically have a diameter within a given tolerance of the inner diameter of the peripheral wall 12 such that the pomade will, at least upon initial production, tend to engage some or all of the inner surface of the peripheral wall 12 in a frictional engagement. In this manifestation of the invention, lugs 14 project in opposition from the outer surface of the peripheral wall 12 for permitting an extension and retraction of the elevator cup 10 and a retained pomade, but it will be understood that other elevator cups might be extended and retracted in a different manner, such as by a stem or some other mechanism.

Figure 4:
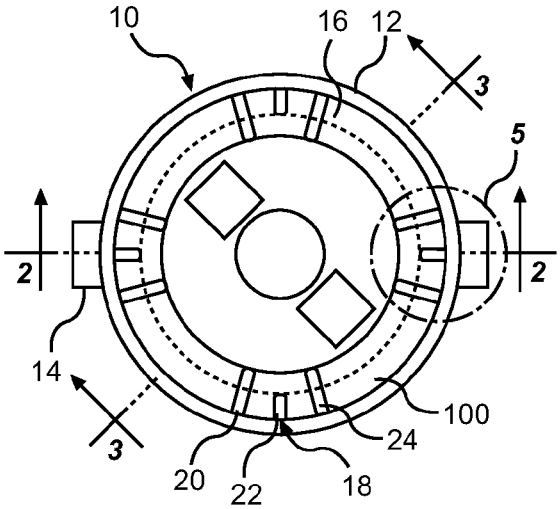
FIG. 4 is a top plan view of the elevator cup of FIG. 1.
Figure 5:
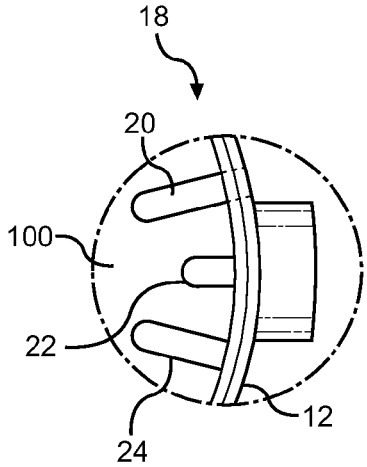
FIG. 5 is a magnified plan view of a portion of the elevator cup of FIG. 1.
Figure 6:
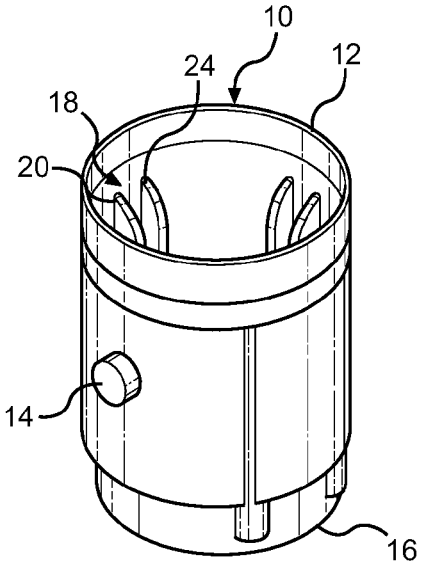
FIG. 6 is a perspective view of an alternative elevator cup as disclosed herein.
Figure 7:
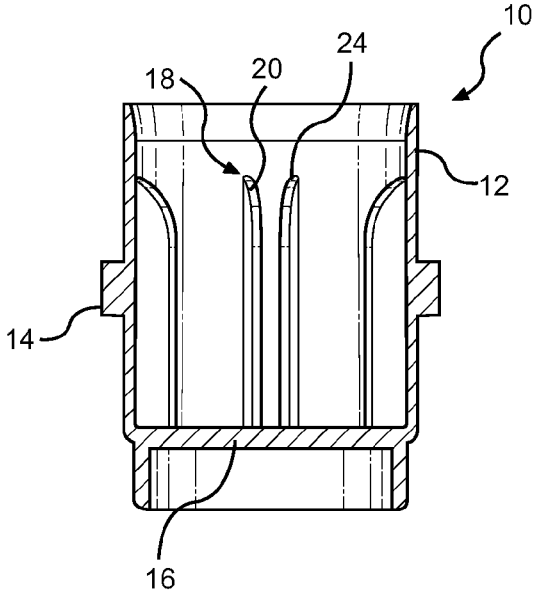
FIG. 7 is a cross-sectional view of the elevator cup of FIG. 6.
Figure 8:
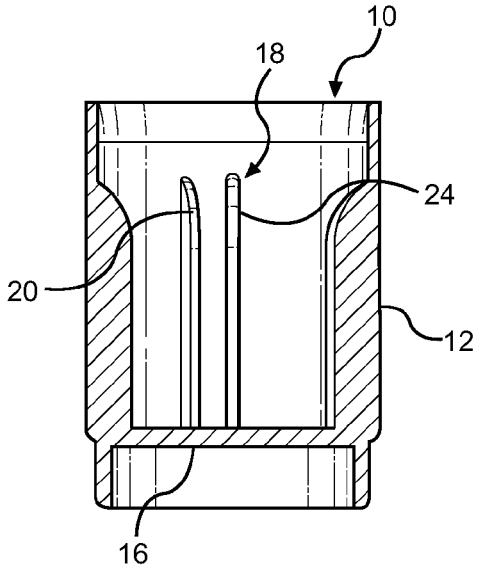
FIG. 8 is an alternative cross-sectional view of the elevator cup of FIG. 6.

A plurality of longitudinal fins 20, 22, and 24 project radially inward from the inner surface of the peripheral wall 12. Each fin 20, 22, and 24 has an elongate body portion of a generally consistent radial dimension, which may alternatively be referred to as a depth, in relation to the peripheral wall 12. Each of the fins 20, 22, and 24 has a tapered tip portion that terminates at the peripheral wall 12. Under the depicted configuration, the several fins 20, 22, and 24 will smoothly slice or be received within a cosmetic pomade thereby to engage and retain the pomade 100 as shown in FIGS. 4 and 5 against orbital and axial movement while avoiding excessive damage to the pomade and structural vulnerabilities deriving therefrom.

In the elevator cup 10 of FIGS. 1 through 5, the fins 20, 22, and 24 are disposed in clusters 18 designed to improve the engagement and retention of the pomade 100 while producing limited negative impact on the pomade. More particularly, the elevator cup 10 has four clusters 18 centered at 90-degree intervals, but it will be understood that fewer or more clusters 18 could be included within the scope of the invention except as it might be expressly limited by the claims. Embodiments are possible with as little as one cluster 18 or as many as twelve or more clusters 18.

In FIGS. 1 through 5, each cluster 18 is formed by first, second, and third fins 20, 22, and 24, but it will be further understood that fewer or more fins 20, 22, and 24 could be included with in the scope of the invention except as it might be expressly limited by the claims. For instance and without limitation, there could be as few as two fins 20, 22, and 24, or there could be as many as eight fins 20, 22, and 24 within a given cluster 18. Here, the fins 20, 22, and 24 are formed integrally with the peripheral and bottom walls 12 and 16, but they could be separately formed and retained by any effective method, including adhesive, sonic or heat welding, mechanical coupling, or any other method or combination thereof.

The fins 20, 22, and 24 within each cluster 18 are spaced by 15 degrees on center such that each cluster 18 occupies approximately 30 degrees along the periphery of the wall 12, and a 60-degree interval is disposed between clusters 18. With that, each cluster 18 produces a three-pronged engagement with the pomade 100 while interposed 60-degree segments of the pomade are left un-pierced and, consequently, without structural compromise. Each interposed segment of un-pierced pomade in this embodiment occupies approximately twice the angular span of the clusters 18.

With the close angular spacing between the fins 20, 22, and 24 within a given cluster 18 and the relatively broad angular spacing between adjacent clusters 18, a stable retention of the pomade 100 is sought to be achieved while excess damage to the pomade is sought to be avoided. With the outboard fins 20 and 24 being separated in this example by effectively less than 30 degrees and the fin 22 being separated in this example from the fins 20 and 24 by effectively less than 15 degrees, the dovetail effect between the fins 20, 22, and 24 will tend to compress and hold the pomade 100 in the volume between the fins 20, 22, and 24 thereby yielding increased friction between the pomade 100 and the enlarged surface areas presented by the clustered fins 20, 22, and 24. The dovetail effect and the resulting compression, frictional resistance, and mechanical retention produced by the clustered fins 20, 22, and 24 are designed to produce better retention not only on initial installation of the pomade 100, but also in the face of the shrinkage that tends to occur with modern cosmetic pomades 100. For instance, as a pomade 100 shrinks, the dovetail portions of the pomade 100 that is disposed between the fins 20, 22, and 24, which are less than forty degrees apart, will tend to be drawn radially inward within the dovetail spaces between the fins 20, 22, and 24 thereby producing further locking retention of the pomade 100 in the cup 10. While the pomade 100 may lose at least some contact with the peripheral wall 12 and perhaps even the very bases of certain fins 20, 22, and 24, the inward movement of the peripheral portions of the pomade 100 is exploited to improve retention as the dovetailed portion of the pomade 100 is pulled into tighter engagement with the dovetailed faces of the fins 20, 22, and 24. The localized, dovetailed portions of the pomade 100 are thus further compressed and restrained against unintentional axial and orbital displacement.

In the present embodiment, the fins 20, 22, and 24 within each cluster 18 differ in radial dimension or depth by which they project from the peripheral wall 12. More particularly, in this example of the invention, the first and third or outboard fins 20 and 24 of each cluster 18 are of substantially equivalent radial dimension to one another while the second, center fin 22 projects radially inward at a lesser radial dimension than the outboard fins 20 and 24. More particularly, the center fin 22 of each cluster 18 has a radial dimension of roughly or slightly more than one-half, more particularly approximately 56%, of the radial dimension of the first and third fins 20 and 24. In this exemplary embodiment, the outer fins 20 and 24 project radially inward by approximately 0.068 inches while the center fin 22 projects radially inward by approximately 0.038 inches with the peripheral wall 12 having an inner diameter of approximately 0.476 inches. With that, the outer fins 20 and 24 project radially inward by about 14% of the inner diameter of the peripheral wall 12. The fins 20, 22, and 24 in this example are each 0.020 inches wide with parallel sidewalls and rounded tips.

Of course, the particular dimensions and angular and dimensional relationships set forth herein are merely exemplary, and the fins 20, 22, and 24, the peripheral wall 12, and other aspects of the elevator cup 10 could vary widely under the invention except as it might be limited by the claims. The radial dimensions of the fins 20, 22, and 24 could vary, whether in proportion or not. While the radial dimension or depth of the fins 20, 22, and 24 might vary further depending on, among other things, the size of the peripheral wall 12 and the pomade 100 to be retained, it is contemplated that fins 20, 22, and 24 in certain embodiments could have fins 20, 22, and 24 ranging in radial dimension between about 0.025 inches and about 0.125 inches. Also, the angular spacing between the fins 20, 22, and 24 within a given cluster 18 could vary. For instance and without limitation, adjacent fins 20, 22, and 24 could in certain practices of the invention be spaced as closely as 8 degrees apart or as far as 40 degrees apart while still creating a dovetail effect as sought herein. To be clear, though, such spacing should not be considered to be required except as the claims might expressly specify.

The illustrated configuration may be considered advantageous in a plurality of ways, including that a first dovetail formation is created between the first and third fins 20 and 24 and then second and third, smaller dovetail formations are formed between the first and second fins 20 and 22 and between the second and third fins 22 and 24. It will be appreciated, however, that it would be possible for the fins 20, 22, and 24 to be generally equal in radial dimension or depth. It would also be possible for the middle fin 22 to be greater in radial dimension or depth than the outboard fins 20 and 24 or for the fins 20, 22, and 24 to vary in depth in some other pattern.

The clustered configuration of the fins 20, 22, and 24 and the positioning and interrelationship of the several clusters 18 with the peripheral wall 12 and the retained cosmetic pomade 100 are designed for stably retaining the pomade 100 against orbital and axial displacement while avoiding excess damage to the pomade 100 and the structural integrity thereof. When a pomade 100 is inserted into the elevator cup 10, the fins 20, 22, and 24 of the clusters 18 will pierce or be received into the body of the pomade 100 with broad, un-pierced portions of the pomade 100 between the clusters 18 and interposed portions of the pomade 100 receiving the three fins 20, 22, and 24 at varying depths. A solid portion of the pomade 100 will be disposed between the outboard first and third fins 20 and 24 while the third, central fin 22 interposed therebetween adds further mechanical and frictional engagement with the pomade 100. The dovetail-shaped openings between the first and third fins 20 and 24 and between the base portions of the first and third fins 20 and 24 and the center, second fin 22 further contribute to the retention of the pomade 100, particularly where the pomade 100 shrinks over time as is commonly the case with modern lipstick pomades.

With plural clusters 18 of multiple fins 20, 22, and 24 disposed as shown and described, the fins 20, 22, and 24 achieve a relatively large total contact area between the pomade 100 and the surfaces of the fins 20, 22, and 24 thereby producing greater frictional retention of the pomade 100 while the shape and size of the fins 20, 22, and 24 prevent excess damage to the integrity of the pomade 100. Furthermore, the close disposition of the fins 20, 22, and 24 within each cluster 18 is intended to produce greater retaining force between the dovetail-shaped portions of the pomade 100 and the sides of the fins 20, 22, and 24 whereby further frictional and mechanical retention will be achieved.

Figure 9:
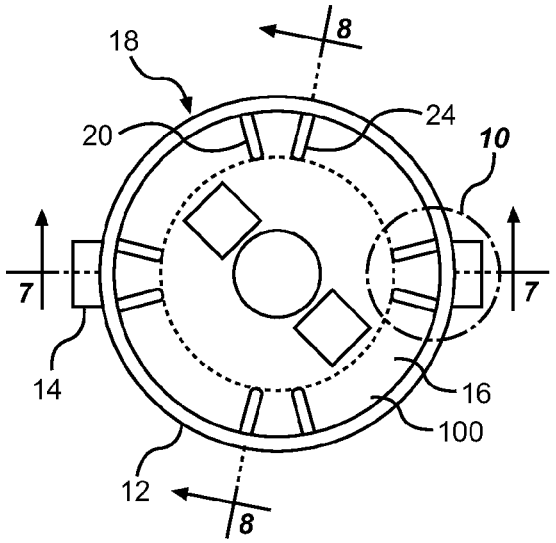
FIG. 9 is a top plan view of the elevator cup of FIG. 6.
Figure 10:
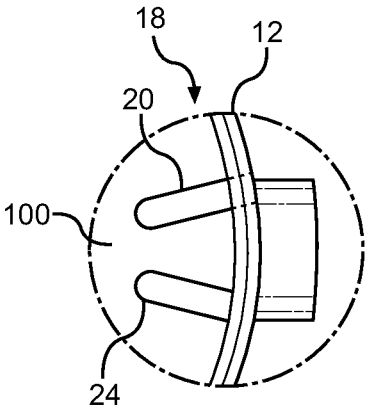
FIG. 10 is a magnified plan view of a portion of the elevator cup of FIG. 6.
Figure 11:
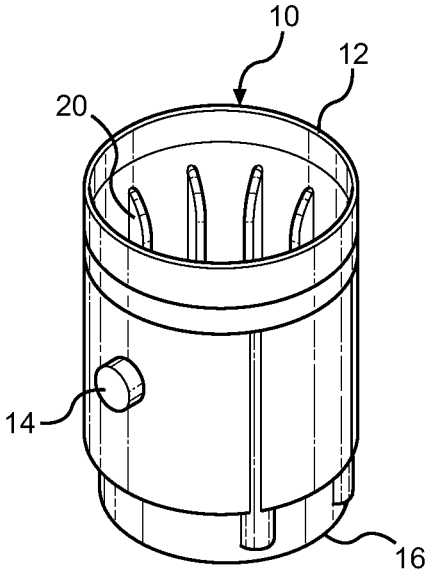
FIG. 11 is a perspective view of an elevator cup as disclosed herein.
Figure 12:
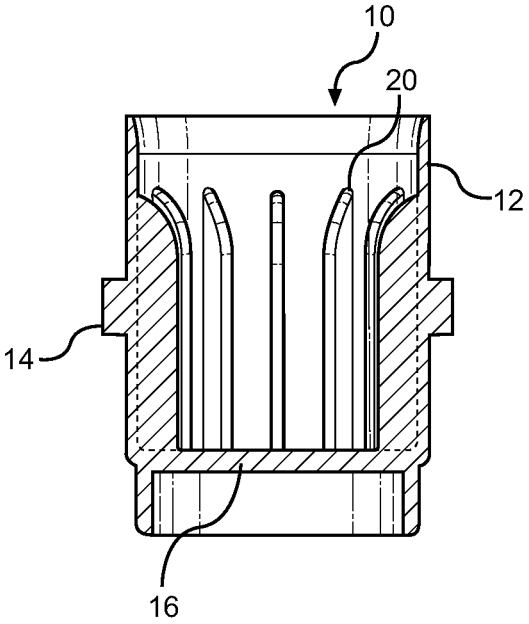
FIG. 12 is a cross-sectional view of the elevator cup of FIG. 11.
Figure 13:
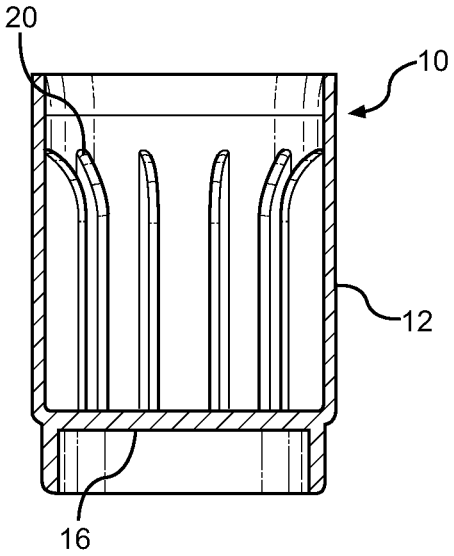
FIG. 13 is an alternative cross-sectional view of the elevator cup of FIG. 11.

An alternative elevator cup 10 pursuant to the present invention is indicated generally at 10 in FIGS. 6 through 10. The elevator cup 10 again has a substantially cylindrical peripheral wall 12 and a flat bottom wall 16 that together form an open inner volume for receiving and retaining a cosmetic pomade as seen in FIGS. 9 and 10. Lugs 14 project in opposition from the outer surface of the peripheral wall 12 for permitting an extension and retraction of the elevator cup 10 and a retained pomade 100.

A plurality of clusters 18 of longitudinal fins 20 and 24 are again spaced around the peripheral wall 12. The longitudinal fins 20 and 24 project radially inward form the inner surface of the peripheral wall 12. Each fin 20 and 24 has an elongate body portion of a generally consistent radial dimension and a tapered tip portion that terminates at the peripheral wall 12. The several fins 20 and 24 are again designed to slice or be received within a cosmetic pomade 100 thereby to engage and retain the pomade 100 against orbital and axial movement while avoiding excessive damage to the pomade 100 and structural vulnerabilities deriving therefrom.

As before, the elevator cup 10 has four clusters 18 centered at 90-degree intervals, but it will again be noted that fewer or more clusters 18 are possible. In the present embodiment, however, each cluster 18 is formed by only first and second fins 20 and 24 with the center fin 22 not included. The fins 20 and 24 within each cluster 18 are spaced by 20 degrees on center with a dovetail-shaped portion therebetween such that an approximately 70-degree interval is disposed between clusters 18. With that, each cluster 18 produces a two-pronged engagement with the pomade 100 while interposed 70-degree segments of the pomade are left un-pierced and, consequently, without structural compromise. The interposed segments of un-pierced pomade 100 occupy approximately three and one-half times the angular span of the clusters 18.

The fins 20 and 24 within each cluster 18 are of substantially consistent radial dimension along their lengths. In one non-limiting example of the invention, the fins 20 and 24 can project radially inward by approximately 0.068 inches with the peripheral wall 12 having an inner diameter of approximately 0.476 inches. Under those and similar proportional sizes, the outer fins 20 and 24 can project radially inward by about 14% of the inner diameter of the peripheral wall 12. The fins 20 and 24 in such an embodiment can be 0.020 inches wide with parallel sidewalls and rounded tips. It will again be noted that there could be fewer or more clusters 18, and the radial depth of the fins 20 and 24 could vary, such as from about 0.025 inches to about 0.125 inches while still producing a dovetail effect as contemplated hereunder. Furthermore, the thickness of the fins 20 and 24 could vary depending on, among other things, the application at hand, so the invention should not be considered limited in that respect except as the claims require. In certain manifestations of the elevator cup 10, for example, the fins 20 and 24 could be between approximately 0.012 inches and 0.125 inches in thickness. Fins 20 and 24 could, by way of example and not limitation, be as close as 8 degrees or as far as 40 degrees apart while still creating a dovetail effect as taught hereunder.

The configuration of the fins 20 and 24 of the clusters 18 and the positioning and interrelationship of the several clusters 18 with the peripheral wall 12 and the retained cosmetic pomade 100 are designed for stably retaining the pomade against orbital and axial displacement while avoiding excess damage to the pomade and the structural integrity thereof. When a pomade 100 is inserted into the elevator cup 10, the fins 20 and 24 of the clusters 18 will pierce or be received into the body of the pomade 100 with broad, un-pierced portions of the pomade 100 between the clusters 18 and interposed portions of the pomade receiving the closely-spaced fins 20 and 24 of each cluster 18. A solid portion of the pomade 100 will be disposed between the fins 20 and 24.

The dovetailed openings between the fins 20 and 24 further contribute to the retention of the pomade 100, particularly where the pomade 100 shrinks over time as is commonly the case with modern lipstick pomades. With four clusters 18 of two fins 20 and 24 disposed as shown and described, the fins 20 and 24 again achieve a relatively large total contact area between the pomade 100 and the surfaces of the fins 20 and 24 thereby producing greater frictional retention of the pomade 100 while the shape and size of the fins 20 and 24 prevent excess damage to the integrity of the pomade 100. The close disposition of the fins 20 and 24 within each cluster 18 is intended to produce greater retaining force between the pomade 100 and the sides of the fins 20 and 24 whereby further frictional and mechanical retention will be achieved.

In a manner similar to the dovetail retention effect sought to be achieved in the embodiment of FIGS. 1 through 5, the present embodiment has the fins 20 and 24 separated by effectively less than 20 degrees. The dovetail effect between the fins 20 and 24 will tend to compress and hold the pomade 100 in the volume between the fins 20 and 24 thereby yielding increased friction between the pomade 100 and the enlarged surface areas presented by the clustered fins 20 and 24. The dovetail effect and the resulting compression, frictional resistance, and mechanical retention produced by the clustered fins 20 and 24 disclosed herein seek to produce better retention not only on initial installation of the pomade 100 but also as the pomade 100 may shrink over time. The dovetail portions of the pomade 100 disposed between the fins 20 and 24 will tend to be drawn radially inward within the dovetail spaces between the fins 20 and 24 thereby producing further locking retention of the pomade 100 in the cup 10. The inward movement of the peripheral portions of the pomade 100 can thus be exploited to improve retention as the dovetailed portion of the pomade 100 is pulled into tighter engagement with the dovetailed faces of the fins 20 and 24. The localized, dovetailed portions of the pomade 100 are thus further compressed and restrained against unintentional axial and orbital displacement.

Figure 14:
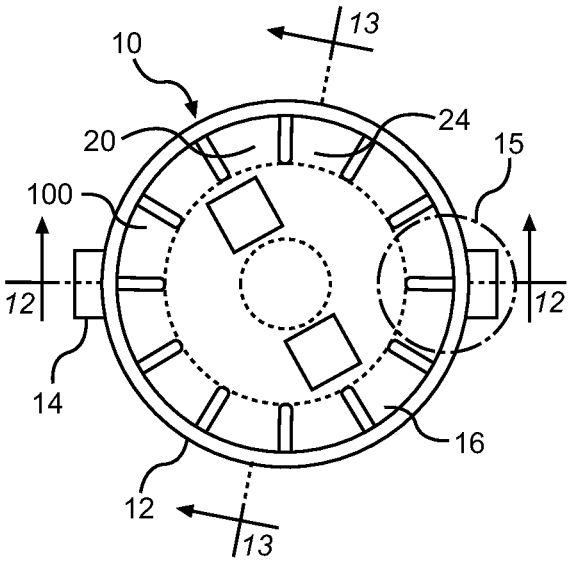
FIG. 14 is a top plan view of the elevator cup of FIG. 11.
Figure 15:
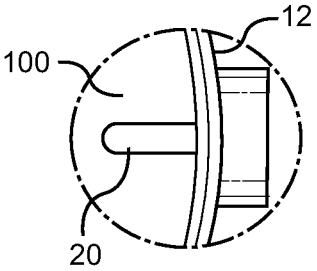
FIG. 15 is a magnified plan view of a portion of the elevator cup of FIG. 11.

The embodiment of the elevator cup 10 depicted in FIGS. 11 through 15 also seeks to provide advantages over the prior art. As described previously, the elevator cup 10 has a substantially cylindrical peripheral wall 12 and a flat bottom wall 16 that together form an open inner volume for receiving and retaining a cosmetic pomade 100 as seen in FIGS. 14 and 15. Lugs 14 project in opposition from the outer surface of the peripheral wall 12 for permitting an extension and retraction of the elevator cup 10 and a retained pomade 100.

In the present embodiment, however, the fins 20 are not disposed in clusters but instead are disclosed in a continuous pattern that, although not a cluster as contemplated herein, are designed to approximate the cluster effect by having repeated, dovetail-shaped spaces between closely spaced fins 20. In the depicted manifestation of this inventive concept, the longitudinally disposed fins 20 are spaced around the peripheral wall 12 at thirty-degree intervals such that twelve fins 20 project radially inward from the peripheral wall 12. As before, each fin 20 has an elongate body portion of a generally consistent radial dimension and a tapered tip portion that terminates at the peripheral wall 12.

In use, the several fins 20 slice into or are received within a cosmetic pomade 100 thereby to engage and retain the pomade 100 against orbital and axial movement while avoiding excessive damage to the pomade 100 and structural vulnerabilities deriving therefrom. With that, the fins 20 produce a twelve-pronged engagement with the pomade 100 with interposed segments of the pomade 100 of thirty degrees minus the width of a fin 20 that are left un-pierced and, consequently, without structural compromise. The dovetail-shaped portions between the fins 20 receive and engage the cosmetic pomade 100 thereby to retain the same through frictional and mechanical resistance. It will be appreciated that the number of fins 20 need not be fixed at twelve. Embodiments could have, by way of example and not limitation, as few as nine fins 20 or perhaps as many as twenty-four or more fins 20.

The fins 20 are of substantially consistent radial dimension. More particularly, the fins 20 in this embodiment project radially inward by approximately 0.068 inches with the peripheral wall 12 having an inner diameter of approximately 0.476 inches. With that, the fins 20 project radially inward by about 14% of the inner diameter of the peripheral wall 12. The fins 20 are each 0.020 inches wide with parallel sidewalls and rounded tips.

Again, however, the foregoing particular dimensions and dimensional relationships are provided merely to provide a better understanding of the disclosed invention with it being noted that different dimensions and dimensional relationships are readily possible within the scope of the invention. Indeed, it is believed that fins 20 can vary from approximately 0.025 to 0.125 inches in radial dimension or depth in projecting inwardly from the peripheral wall 12 and from approximately 0.012 inches to 0.035 inches in width while still achieving the dovetail locking effect sought hereunder.

The configuration of the fins 20 and their proportion in relation to the peripheral wall 12 and the retained cosmetic pomade 100 are designed for stably retaining the pomade 100 against orbital and axial displacement while avoiding excess damage to the pomade 100 and the structural integrity thereof. When a pomade 100 is inserted into the elevator cup 10, the fins 20 will pierce or be received into the body of the pomade 100 with un-pierced portions of the pomade 100 between the fins 20. With the fins 20 effectively spaced with less than thirty degrees therebetween, dovetailed openings are provided between adjacent fins 20.

The dovetailed openings between adjacent fins 20 further contribute to the retention of the pomade 100, particularly where the pomade 100 shrinks over time as is commonly the case with modern lipstick pomades 100. With twelve fins 20 disposed as shown and described, the fins 20 again achieve a relatively large total contact area between the pomade 100 and the surfaces of the fins 20 thereby producing greater frictional retention of the pomade 100 while the shape and size of the fins 20 prevent excess damage to the integrity of the pomade 100. Furthermore, the close disposition of the fins 20, such as at thirty-degree intervals, is intended to produce greater retaining force between the pomade 100 and the sides of the fins 20 whereby further frictional and mechanical retention will be achieved.

In a manner similar to the embodiments described above, the dovetail effect between the fins 20 will tend to compress and hold the pomade 100 in the volume between adjacent fins 20 thereby yielding increased friction between the pomade 100 and the enlarged surface areas presented by the twelve fins 20 of this embodiment. The dovetail effect and the resulting compression, frictional resistance, and mechanical retention produced by the closely spaced fins 20 disclosed herein seek to produce better retention not only on initial installation of the pomade 100 but also as the pomade 100 may shrink over time. The dovetail portions of the pomade 100 disposed between the fins 20 will tend to be drawn radially inward within the dovetail spaces between the fins 20 thereby producing further locking retention of the pomade 100 in the cup 10. The inward movement of the peripheral portions of the pomade 100 can thus be exploited to improve retention as the dovetailed portion of the pomade 100 is pulled into tighter engagement with the dovetailed faces of adjacent fins 20. The localized, dovetailed portions of the pomade are thus further compressed and restrained against unintentional axial and orbital displacement.

Figure 16:
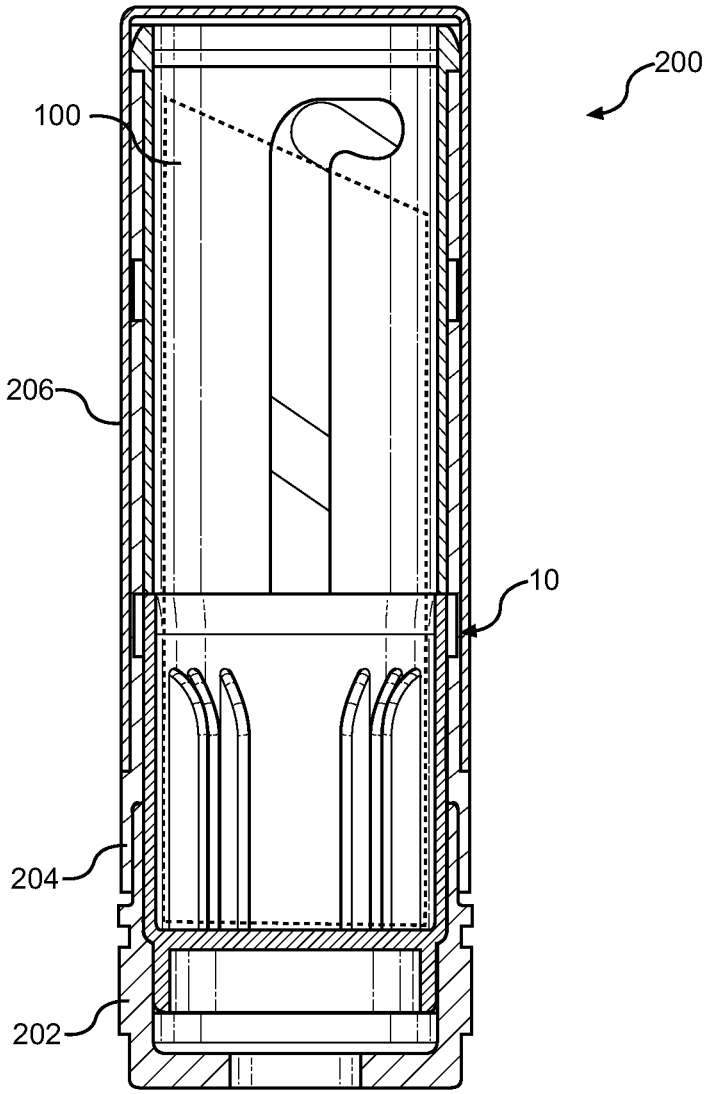
FIG. 16 is a cross-sectional view in front elevation of a cosmetic dispenser incorporating an elevator cup as disclosed herein.

It will again be noted that the elevator cup 10 could be applied to similar advantage in relation to cosmetic and other dispensers of widely varied constructions. To ensure a complete understanding of the invention, an elevator cup 10 as taught herein is shown incorporated into one possible type of cosmetic dispenser in FIG. 16 where the cosmetic dispenser is indicated generally at 200. There, the cosmetic dispenser 200 is founded on a tubular inner body 202 that is rotatably engaged with a spiral member 204. As is known in the art, a relative rotation between the inner body 202 and the spiral member 204 yields an axial movement of the elevator cup 10, which is employed to retain a cosmetic pomade 100 between an extended disposition and a retracted disposition, which is depicted in FIG. 16. A tubular shell 206, which can be essentially decorative in nature, can partially or substantially encase the spiral member 204 and, derivatively, the elevator cup 10 and pomade 100 disposed therewithin.

With certain details and embodiments of the present invention for an elevator cup disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. An elevator cup for retaining a cosmetic pomade in relation to a cosmetic dispenser, the elevator cup comprising:

an annular peripheral wall that defines an inner volume for longitudinally receiving and retaining the cosmetic pomade; and a plurality of fins that project radially inward from the peripheral wall wherein the fins are longitudinally disposed within the inner volume defined by the annular peripheral wall, wherein at least some of the fins are disposed in a cluster comprising at least two fins, and wherein the fins of the cluster are spaced over an angular span;

wherein there are plural clusters, each cluster comprising at least two fins, wherein the clusters are separated by angular spans and wherein the angular spans separating the clusters are greater than the angular spans of the clusters.

2. The elevator cup of claim 1 wherein the fins of the cluster are spaced over an angular span of approximately forty degrees or less.

3. The elevator cup of claim 1 wherein there are at least three fins in the cluster whereby the cluster has at least one central fin and first and second outer fins.

4. A cosmetic applicator with the elevator cup of claim 1 for retaining a cosmetic pomade.

5. An elevator cup for retaining a cosmetic pomade in relation to a cosmetic dispenser, the elevator cup comprising:

an annular peripheral wall that defines an inner volume for longitudinally receiving and retaining the cosmetic pomade; and a plurality of fins that project radially inward from the peripheral wall wherein the fins are longitudinally disposed within the inner volume defined by the annular peripheral wall, wherein at least some of the fins are disposed in a cluster comprising at least two fins, and wherein the fins of the cluster are spaced over an angular span;

wherein there are plural clusters, each cluster comprising at least two fins, wherein the clusters are separated by angular spans and wherein the fins of the cluster are spaced by approximately twenty degrees or less.

6. The elevator cup of claim 5 wherein the cluster has two fins.

7. The elevator cup of claim 5 wherein the cluster has three fins.

8. The elevator cup of claim 5 wherein the cluster has not more than eight fins.

9. A cosmetic applicator with the elevator cup of claim 5 for retaining a cosmetic pomade.

10. An elevator cup for retaining a cosmetic pomade in relation to a cosmetic dispenser, the elevator cup comprising:

an annular peripheral wall that defines an inner volume for longitudinally receiving and retaining the cosmetic pomade; and a plurality of fins that project radially inward from the peripheral wall wherein the fins are longitudinally disposed within the inner volume defined by the annular peripheral wall, wherein at least some of the fins are disposed in a cluster comprising at least two fins, and wherein the fins of the cluster are spaced over an angular span;

wherein there are at least three fins in the cluster whereby the cluster has at least one central fin and first and second outer fins wherein the central fin projects radially inward from the peripheral wall by a distance less than a distance that the first and second outer fins project radially inward from the peripheral wall.

11. A cosmetic applicator with the elevator cup of claim 10 for retaining a cosmetic pomade.

12. An elevator cup for retaining a cosmetic pomade in relation to a cosmetic dispenser, the elevator cup comprising:

an annular peripheral wall that defines an inner volume for longitudinally receiving and retaining the cosmetic pomade; and a plurality of fins that project radially inward from the peripheral wall wherein the fins are longitudinally disposed within the inner volume defined by the annular peripheral wall, wherein at least some of the fins are disposed in a cluster comprising at least two fins, and wherein the fins of the cluster are spaced over an angular span;

wherein there are at least three fins in the cluster whereby the cluster has at least one central fin and first and second outer fins wherein the first and second outer fins of the cluster are spaced over an angular span of approximately forty degrees or less.

13. A cosmetic applicator with the elevator cup of claim 12 for retaining a cosmetic pomade.

14. An elevator cup for retaining a cosmetic pomade in relation to a cosmetic dispenser, the elevator cup comprising:

an annular peripheral wall that defines an inner volume for longitudinally receiving and retaining the cosmetic pomade; and a plurality of fins that project radially inward from the peripheral wall wherein the fins are longitudinally disposed within the inner volume defined by the annular peripheral wall, wherein at least some of the fins are disposed in a cluster comprising at least two fins, and wherein the fins of the cluster are spaced over an angular span wherein there are at least two clusters.

15. The elevator cup of claim 14 wherein the clusters are spaced substantially evenly around the annular peripheral wall.

16. A cosmetic applicator with the elevator cup of claim 14 for retaining a cosmetic pomade.

* * * * *